US005208626A

United States Patent [19]

Tanimoto et al.

[11] Patent Number: 5,208,626

[45] Date of Patent: May 4, 1993

[54] IMAGE FORMING APPARATUS HAVING A DETACHABLY MOUNTED PROCESSING UNIT

[75] Inventors: Yasufumi Tanimoto, Kanagawa; Takashi Saitoh, Tokyo, both of Japan

[73] Assignee: Kabushiki Kaisha Toshiba, Kawasaki, Japan

[21] Appl. No.: 796,586

[22] Filed: Nov. 22, 1991

[30] Foreign Application Priority Data

Nov. 28, 1990 [JP] Japan ..... 2-328477

[51] Int. Cl.[5] ..... G03G 15/00

[52] U.S. Cl. ..... 355/200; 355/203; 355/208

[58] Field of Search ..... 355/203, 204, 205, 206, 355/207, 208, 209, 210, 245, 200

[56] References Cited

U.S. PATENT DOCUMENTS 3,985,436 10/1976 Tanaka et al. .
4,496,237 1/1985 Schron ..... 355/204 X
4,588,282 5/1986 Levine ..... 355/204 X
4,922,294 5/1990 Nakagami et al. ..... 355/209
4,987,447 1/1991 Ohjha ..... 355/204
5,051,778 9/1991 Watanabe et al. ..... 355/200
5,063,409 11/1991 Nakajima ..... 355/200
5,066,978 11/1991 Watarai et al. ..... 355/206
5,077,581 12/1991 Suzuki ..... 355/200

*Primary Examiner*—A. T. Grimley
*Assistant Examiner*—T. A. Dang
*Attorney, Agent, or Firm*—Foley & Lardner

[57] ABSTRACT

An image forming apparatus has a detachably mounted processing unit on a main body of the apparatus. The processing unit includes the image bearing member and a processing device for acting on the image bearing member to form an image on the image bearing member. The processing unit is replaced with a new processing unit when the service life of the processing unit expires. The image forming apparatus also has a first memory for storing the amount of use of the processing unit, a second memory for storing maintenance message information for replacing the processing unit with a new processing unit when the service life of the mounted processing unit expires and a causing device for causing the processing device of the processing unit to form the maintenance message information stored in the second memory on the image bearing member when the amount of use reaches a predetermined value. Thus, the maintenance message information stored in the second memory is printed on a recording medium when the service life of the mounted processing unit expires.

9 Claims, 8 Drawing Sheets

Fig. 8. A
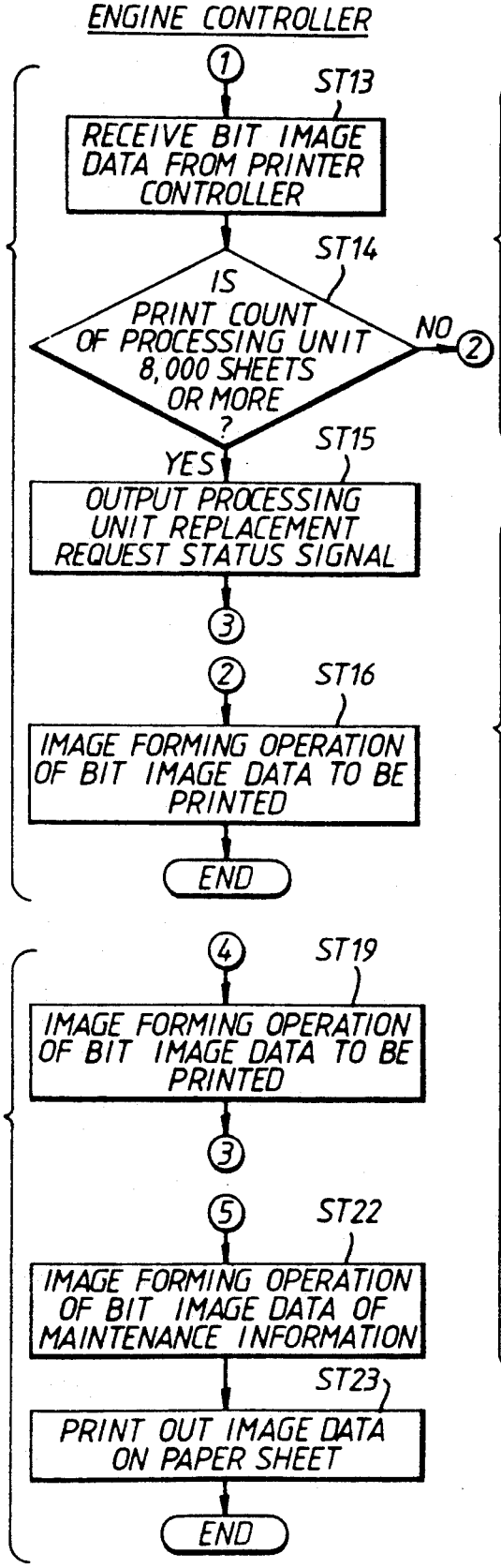
Fig. 8. B
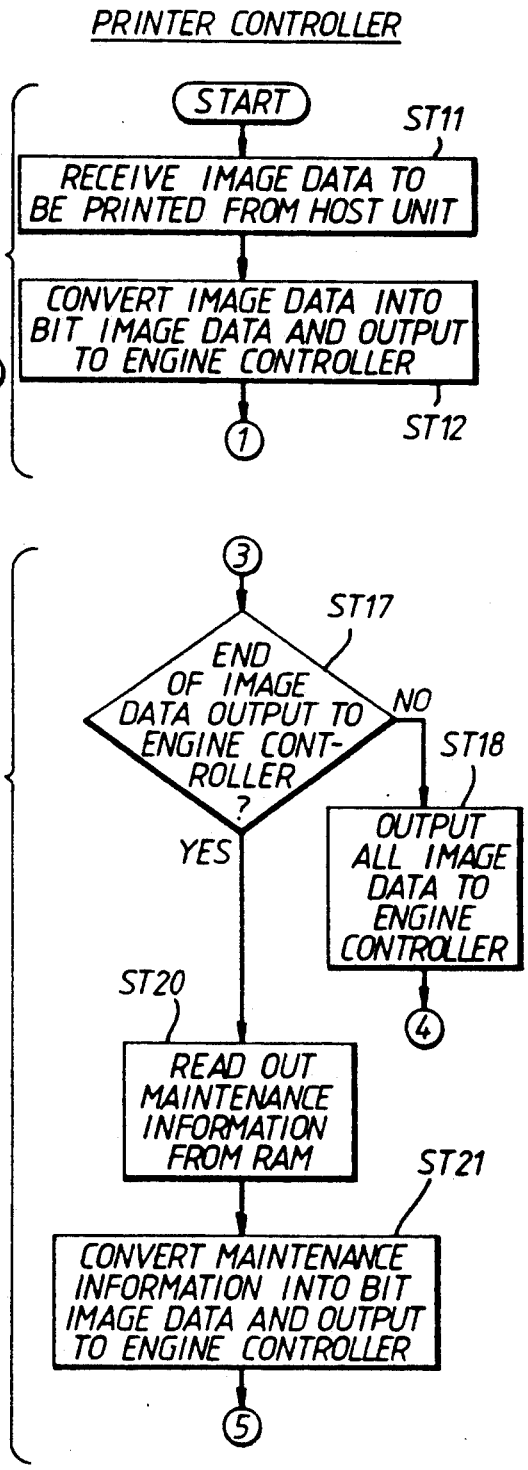

IMAGE FORMING APPARATUS HAVING A DETACHABLY MOUNTED PROCESSING UNIT

BACKGROUND OF THE INVENTION

1. Field of the Invention

This invention relates to an image forming apparatus, such as a laser printer, for forming an image on an image bearing member and, more particularly, to an image forming apparatus having a detachably mounted process unit.

2. Description of the Related Art

Generally, in a conventional image forming apparatus, a latent image is first formed on an image bearing member. A developing device then develops the latent image, using a toner to make the latent image visible.

In recent image forming apparatus designs, several elements of the apparatus have been contained in one casing, so as to form a replaceable unit (herein referred to as a "processing unit"). For example, the image bearing member and the developing device having a toner supply device have been contained in a single processing unit, which may be detached from the apparatus and replaced with a new processing unit upon expiration of its service life. U.S. Pat. No. 3,985,436 discloses an image forming apparatus wherein the image bearing member, the developing device and the cleaning device are contained in a single unit. This unit is replaced with a new unit when the service life of the image bearing member expires. Thus, all the devices contained within the single unit are exchanged simultaneously.

In the above-described image forming apparatus, the user must somehow be informed as to when the service life of the processing unit expires, in order to maintain high quality imaging. In other words, the image forming apparatus must include a service life management device.

In a conventional image forming apparatus, the service life management device is a counter for detecting the amount of use of the processing unit. The processing unit is then replaced when the counter indicates a certain predetermined number. Also, in order to perform replacement of the processing unit, a message indicating that the processing unit should be changed may then be displayed on a display unit of the laser printer when the service life of the processing unit expires. However, since the display area of the display unit is generally small, the message indicating that the processing unit should be changed must be displayed with a symbol or short sentence. The operator may not accurately understand the content of the message. Thus, the user may not replace the processing unit immediately after the message is displayed on the display unit of the laser printer. When the replacement of the processing unit is not performed at an optimal timing, accurate image forming may not be performed.

Also, an non-expert user performs the replacement of the processing unit in accordance with instructions (an explication of the operation and a picture) described an operation manual. It is, however, cumbersome for the non-expert user to find desired instructions from the operation manual when the non-expert user replaces with the processing unit.

SUMMARY OF THE INVENTION

Accordingly, it is an object of the present invention to provide a simple and reliable service life management device for a replaceable processing unit of an image forming apparatus.

It is a further object of the present invention to provide an image forming apparatus which forms maintenance message information for replacing the process unit with a new processing unit when the service life of the processing unit expires, so as to easily perform the replacement of the processing unit.

Accordingly, the foregoing and other objectives are achieved by the present invention, which provides an image forming apparatus having a detachably mounted processing unit. The processing unit contains an image bearing member and a processing device for acting on the image bearing member to perform an image forming operation, and is replaced with a new processing unit when the service life of the mounted processing unit expires. The image forming apparatus also has a first memory for storing the amount of use of the processing unit, a second memory for storing maintenance message information containing instruction for replacing the processing unit with the new processing unit when the service life of the mounted processing unit expires and a causing device. The causing device causes the processing device of the processing unit to form the maintenance message information stored in the second memory on the image bearing member when the amount of use of the mounted processing unit reaches a predetermined value, so that the maintenance message information is printed on a recording medium.

A further aspect of the present invention provides an image forming apparatus for performing an image forming operation, to form an image corresponding to data received from a host unit. The image forming apparatus has a processing unit detachably mounted on a main body of the image forming apparatus. The processing unit has the image bearing member and processing device for acting on the image bearing member to perform the image forming operation and is replaced with a new processing unit when the service life of the mounted processing unit expires. The image forming apparatus also includes a first memory for storing the amount of use of the processing unit and a second memory for storing maintenance message information containing instruction for replacing the processing unit with the new processing unit when the service life of the mounted processing unit expires. The image forming apparatus further contains a first detecting device for detecting when the amount of use stored in the first memory means reaches a predetermined value and outputing a signal, a second detecting device responsive to the signal received from the first detecting device for detecting when the image forming operation in response to data received from a host unit is completely performed in response to the first detecting device. The causing device causes the processing means so as to form the maintenance message information stored in the second memory on the image bearing member in response to the second detecting device, so that the maintenance message information is printed on a recording medium.

BRIEF DESCRIPTION OF THE INVENTION

A more complete appreciation of the present invention and the attendant advantages thereof will be readily obtained as the invention becomes better understood by reference to the following detailed description, when considered in connection with the accompanying drawings, wherein:

FIGS. 8A and 8B are flow diagrams explaining the respective operations of the engine controller and the printer controller of the image forming apparatus shown in FIG. 1.

DETAILED DESCRIPTION OF THE PREFERRED EMBODIMENTS

Figure 1:
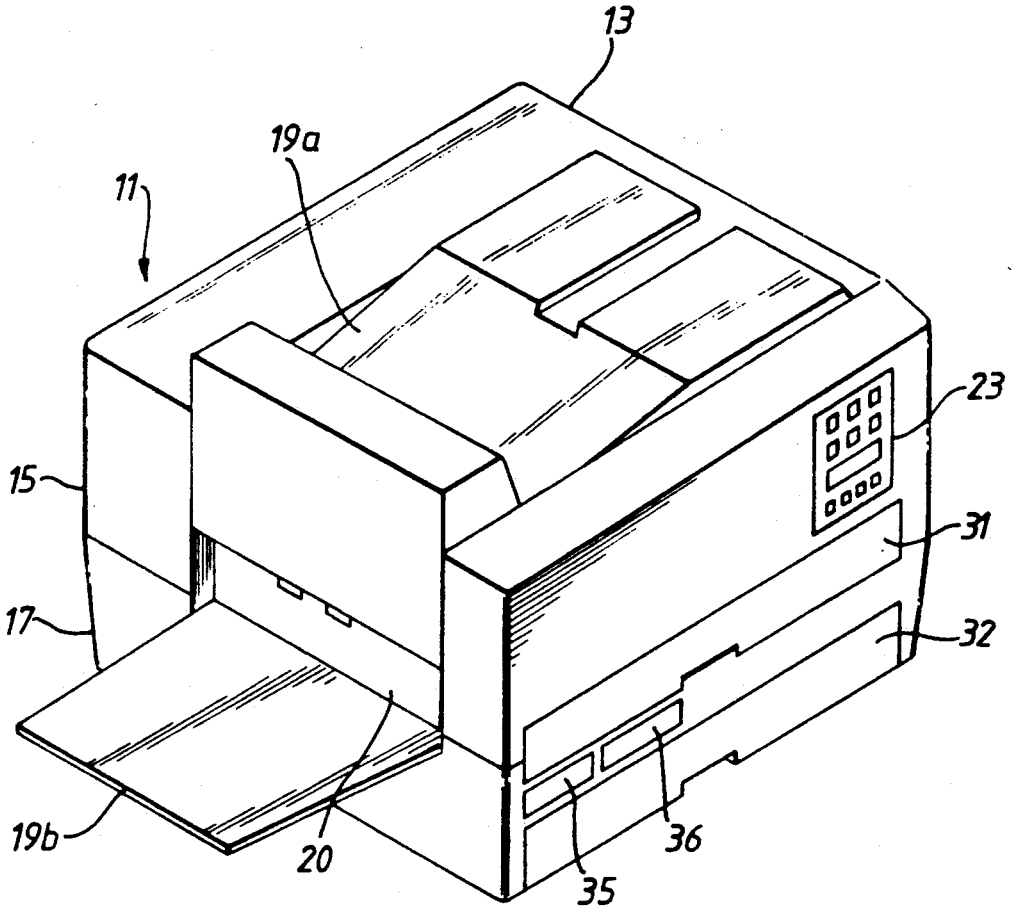
FIG. 1 is a perspective view of an image forming apparatus according to the present invention.
Figure 6:
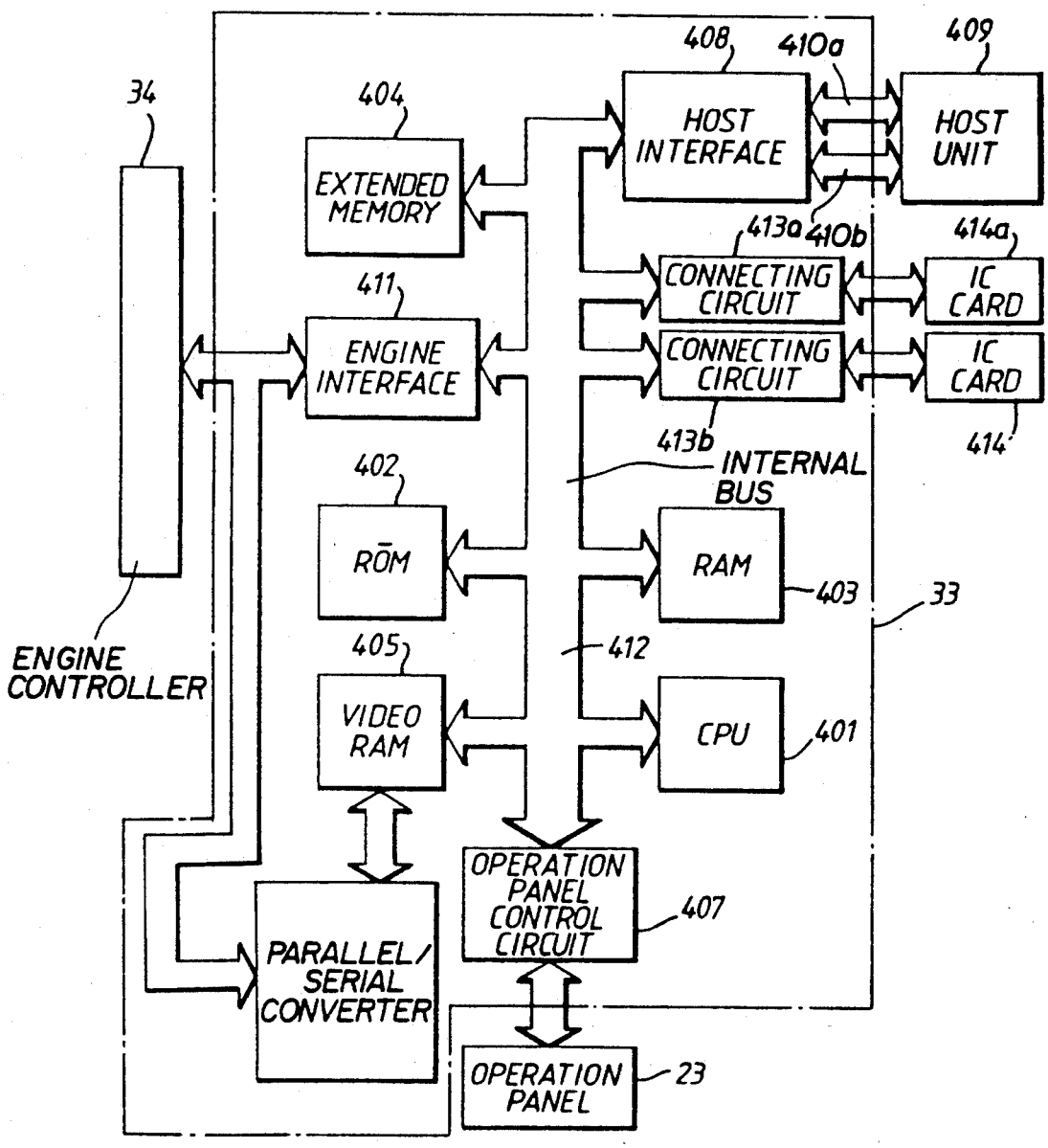
FIG. 6 is a block diagram showing an arrangement of a printer controller of the image forming apparatus shown in FIG. 1.

FIG. 1 shows an image forming apparatus according to the present invention. The image forming apparatus may be, of course, one of a wide variety known in the prior art. For purpose of example, however, the image forming apparatus depicted is a laser printer. Laser printer 11 may serve as an output device for a host unit 409, as shown in FIG. 6. In response to a print command from host unit 409, laser printer 11 performs an image forming operation to form an image on a paper sheet according to data supplied from host unit 409. The paper sheet is fed to a user via trays 19*a*, 19*b*.

Figure 4:
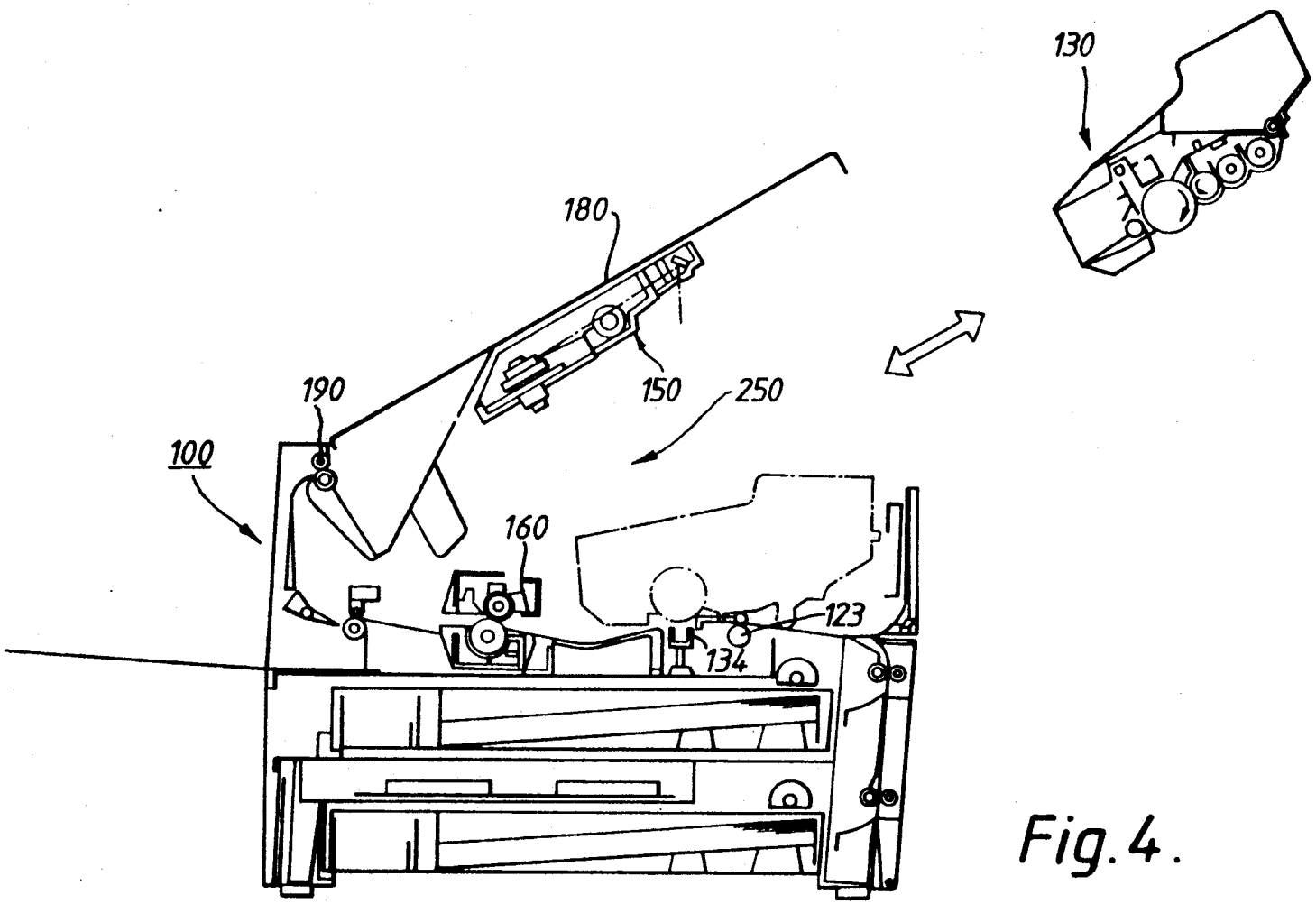
FIG. 4 is a view of the image forming apparatus section shown in FIG. 2 with its top portion lifted open.

Laser printer 11 includes a body 13 having an upper cover 15 and a lower frame 17. Upper cover 15 covers a part of the upper portion of body 13. Upper cover 15 is mounted by a hinge to body 13 and may be opened away from frame 17 as shown in FIG. 4.

A first output tray 19*a* is located on the upper portion of body 13 to receive printed paper sheet from laser printer 11. A recess 20, used as paper sheet discharge section, is formed on the front surface of body 13. A second output tray 19*b* is located on the bottom edge portion of recess 20, so that second output tray 19*b* may receive printed paper sheets through recess 20. A control panel 23 is located on a surface portion of body 13. Control panel 23 includes a plurality of visual displays, e.g. (light emitting diodes), and may include a status indicator for indicating the operating status of printer 11.

First and second paper supply cassettes 31 and 32 are inserted into a lower portion of body 13. For purpose of reference, the side of printer 11 into which cassettes 31 and 32 are inserted will hereinafter be referred to as the front side of printer 11. Cassettes 31 and 32 hold a supply of paper sheet P, as shown in FIG. 2.

A printer controller 33 and an engine controller 34 for controlling the image forming operation of laser printer 11 are provided between first paper supply cassette 31 and second paper supply cassette 32.

Connectors 35 and 36 are also located on a surface portion of body 13. A programming cartridge, a IC card or the like (not shown) may be plugged into connectors 35 and 36 for programming special printer functions.

Figure 2:
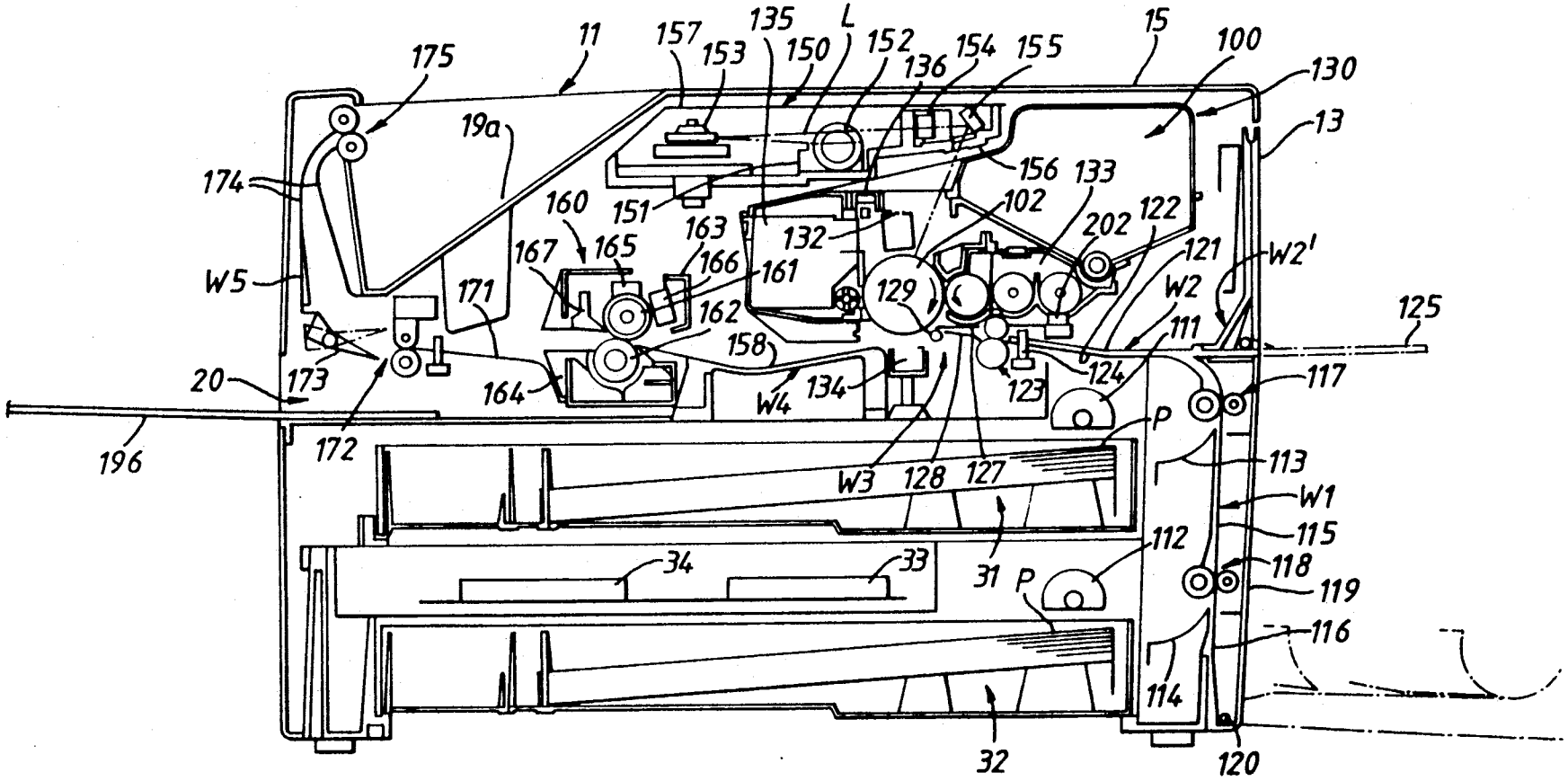
FIG. 2 is a sectional view of the image forming apparatus shown in FIG. 1.

Referring now to FIG. 2, the internal constraction of laser printer 11 will be described.

An image forming unit 100 includes an image bearing member 102, i.e. a photosensitive drum for forming a latent image in response to light. Image bearing member 102 is rotated by an electric motor (not shown). A laser unit 150 radiates a laser beam L so that a latent image is formed on the surface of image bearing member 102.

Laser unit 150 includes a semiconductor laser 151 for generating laser beam L in response to data supplied from host unit 409. Laser beam L is directed to a polygonal mirror 153 via a condenser lens 152. Polygonal mirror 153 reflects laser beam L so that laser beam L scans the surface of image bearing member 102 through first and second lenses 154 and 155, and a third lens 156. First lens 154 may be a condenser lens, second lens 155 may be a F$\theta$ lens and third lens 156 may be a glass lens. Laser unit 150 is mounted in a casing 157, which may be made of synthetic resin.

A developing unit 133 is located adjacent image bearing member 102. Developing unit 133 develops the latent image with a toner in order to form a visible image.

A transfer unit 134 is located down stream of developing unit 133 along the rotational direction of image bearing member 102. At the image transfer position, transfer unit 134 faces image bearing member 102. Transfer unit 134 transfers the toner image onto paper sheet P supplied from cassettes 31 and 32. A cleaning unit 135 is located down stream of transfer unit 134 along the rotational direction of image bearing member 102. Cleaning unit 135 cleans the surface of image bearing member 102 so as to remove the residual toner after transfer of the toner image by transfer unit 134. A discharging unit 136 and a charging unit 132 are located down stream of laser unit 150 along the rotational direction of image bearing member 102. Discharging unit 136 includes a lamp (not shown) for radiating the surface of image bearing member 102 in order to set the electrical potential of the surface of image bearing member 102 to a predetermined uniform level. After the electrical potential of the surface of image bearing member 102 is set, charging unit 132 charges the entire surface of image bearing member 102 in order to prepare the surface for forming a latent image.

Image bearing member 102, developing unit 133, cleaning unit 135, discharging unit 136 and charging unit 132 are mounted in a processing unit 130 as a single body. Processing unit 130 is detachably mounted in body 13.

Pickup rollers 111 and 112 are respectively provided at the top ends of cassettes 31 or 32 when cassettes 31 and 32 are inserted into body 13 of the laser printer, as shown in FIG. 2. Pickup rollers 111 and 112 have semicircular cross-section and are provided with flat surfaces. Thus, when the respective flat surfaces of pickup roller 111 and 112 face cassettes 31 and 32, pickup rollers 111 and 112 do not contact the supplies of paper sheet P. However, when the curved surfaces of pickup rollers 111 and 112 are in contact with the supplies of paper sheet P, the roller may each pick up a paper sheet during its rotation. Paper sheet P, when picked up from cassettes 31 or 32, is then transported to an image transfer position through a first feeding path W1, a second feeding path W2 and a third feeding path W3.

First feeding path W1 is near cassettes 31 and 32. First feeding path W1 comprises feeding guides 113, 114, 115 and 116 and two pairs of conveying rollers 117 and 118. Feeding guides 113, 114, 115 and 116 are formed integral with a side face cover 119 of body 13 and can be accessed by opening side face cover 119, which pivots on support shaft 120. Side face cover 119 is shown in its open position by dashed lines in FIG. 2.

Second feeding path W2 for feeding paper sheet P towards the image transfer position is arranged downstream of first feeding path W1. Second feeding path W2 comprises feeding guides 121 and 122, and a pair of aligning rollers 123. Aligning switch 124 for detecting the passage of paper sheet P is arranged upstream of aligning rollers 123.

Third feeding path W3 is located downstream of aligning rollers 123 for guiding paper sheet P to the image transfer position. Third feeding path W3 includes a pair of upper and lower feeding guides 127 and 128, and a transfer guide roller 129.

Laser printer 11 may also include a manual feeding tray 125 inserted into the left side of body 13 and shown by dashed lines in FIG. 2. Manual feeding tray 125 is used as a guide for manually feeding individual paper sheets for printing. When paper sheet P is fed manually from feeding tray 125, a feeding path W2' second feeding path W2 and third feeding path W3 introduce paper sheet P to the image transfer position. Feeding path W2' merges with second feeding path W2 near the side of body 13 adjacent manual feeding tray 125.

A fixing unit 160 is located down stream of the image transfer position. Fixing unit 160 fixes the toner image onto paper sheet P by heating and pressing paper sheet P with the toner image. Fixing unit 160 comprises a heating roller 161 and a pressing roller 162 for pressing against heating roller 161. Heating roller 161 and pressing roller 162 are enclosed by an upper casing 163 and a lower casing 164 to maintain the proper temperature for fixing the toner image on paper sheet P. A cleaner 165 for cleaning the surface of heating roller 161, a thermistor 166 for detecting the surface temperature of heating roller 161 and a separation guide 167 for ensuring reliable separation of paper sheet P from heating roller 161 are respectively arranged around the heating roller 161.

A guide 158 is located between the image transfer position and fixing unit 160. Paper sheet P from image transfer position is transported to fixing unit 160 along guide 158.

An eject path W5 is located downstream of fixing unit 160. Eject path W5 ejects paper sheet P with the fixed toner image onto receiving tray 19*a* or 19*b*. Eject path W5 comprises a first eject guide 171, first pair of paper eject rollers 172, gate 173, second pair of eject guides 174 and second pair of paper eject rollers 175. Gate 173 selects the eject position of paper sheet P with the fixed toner image. Thereby, paper sheet P is transported from cassetes 31, 32 or manual feeding tray 125 to output trays 19*a* or 19*b*.

Figure 3:
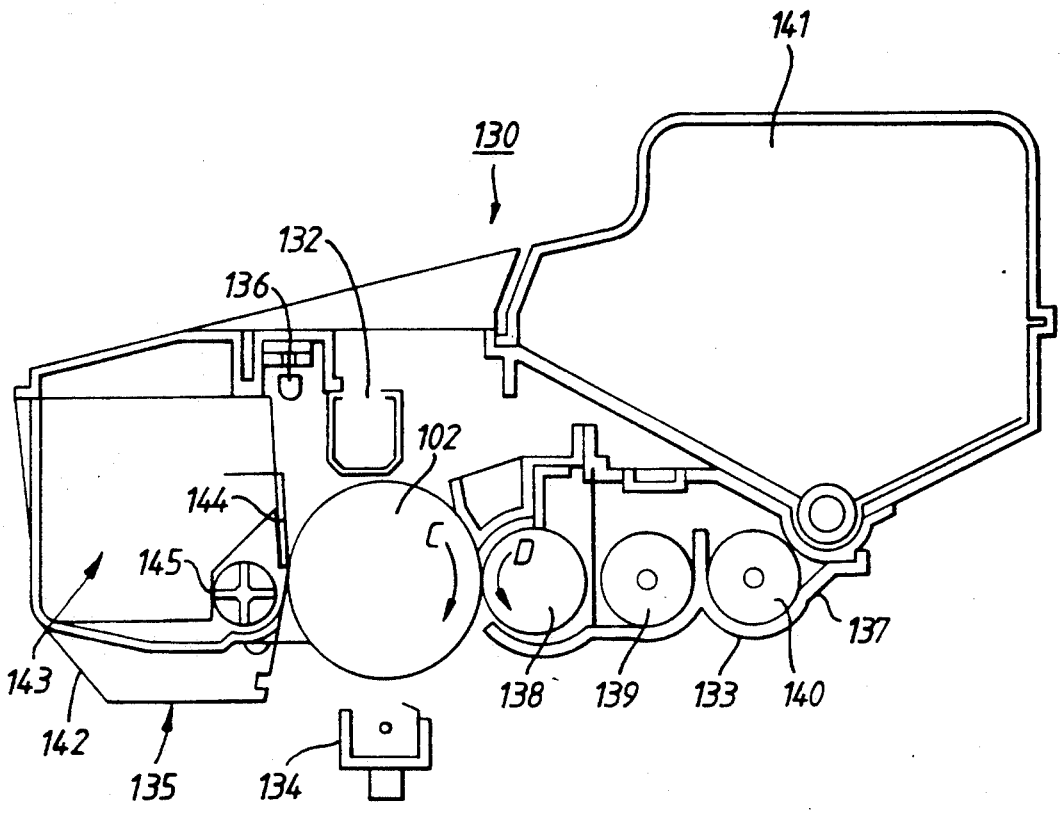
FIG. 3 is a sectional view of a processing unit of the image forming apparatus shown in FIG. 1.

Referring now to FIGS. 3 and 4, the details of processing unit 130 will be explained. As shown in FIG. 3, processing unit 130 includes image bearing member 102, charging unit 132, developing unit 133, cleaning unit 135 and discharging unit 136, which are respectively arranged around image bearing member 102 in the direction shown by arrow C.

Developing unit 133 develops a latent image formed on image bearing member 102 by using a two-component developer having toner and carrier. Developing unit 133 includes a developing roller 138 having a magnet (not shown) and a pair of feeding rollers 139 and 140. Developing roller 138 and feeding rollers 139 and 140 are arranged within a developing casing 137. Developing unit 133 also includes toner replenishing unit 141 for replenishing toner to developing unit 133.

Cleaning unit 135 includes a toner receiving unit 143 for receiving toner removed from image bearing member 102, an elastic blade 144 contacts the surface of image bearing member 102 to scrape the residual toner on the surface of image bearing member 102, and a toner feed roller 145 feeds the scraped toner into toner receiving unit 143. Toner receiving unit 143, elastic blade 144 and toner feed roller 145 are arranged within a cleaning casing 142.

As shown in FIG. 4, processing unit 130 may be detachably mounted in body 13. In a preferred embodiment of the present invention, upper cover 15 is mounted at an opening section in an upper portion of body 13. Laser unit 150 is provided at an inner side of the upper cover 15. Upper cover 15 is moved about a hinge 190 provided at the upper portion of body 13 so that upper cover 15 can be opened at a convenient angle of, for example, about 60 degrees from the horizontal. When upper cover 15 is lifted upwardly, processing unit 130 may be removed from an opening portion 250 of body 13. Processing unit 130, therefore, may be easily detached from body 13 and replaced with a new processing unit when the service life of processing unit 130 has expired. Furthermore, in a preferred embodiment, fixing unit 160 and paper feeding path W5 near fixing unit 160 are exposed in the opening portion 250, when upper cover 15 is lifted. Therefore, a jammed paper sheet P may be removed and the maintenance operations of various units may be performed easily and effectively.

Referring again to FIG. 2, a detecting device (counter) 202 for measuring the amount of use of processing unit 130 is located in body 13 of laser printer 11. Detecting device 202 is used for performing the service life management of processing unit 130 in order to inform a user of the expiration of the service life of processing unit 130. Detecting device 202 may be coupled to aligning switch 124 or to aligning rollers 123 and counts the passage of paper sheets P that pass through aligning rollers 123.

Figure 5:
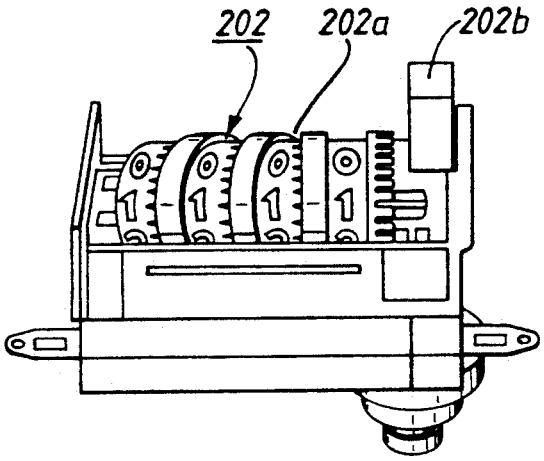
FIG. 5 is a side view of a detecting device for measuring the amount of use of the processing unit shown in FIG. 4.

As shown in FIG. 5, detecting device 202 may include a counting portion 202*a* having an initialized value of "0000" and an initializing switch 202*b* for performing an initializing operation of counting portion 202*a*. The count contained in detecting device 202 is increased by 1 every time a paper sheet P passes through aligning rollers 123.

FIG. 6 shows an arrangement of a main part of printer controller 33.

Referring to FIG. 6, printer controller 33 includes a CPU 401 for overall control of laser printer 11, and a memory (ROM) 402 for storing a control program. CPU 401 is operated in accordance with the control program stored in ROM 402. ROM 402 also stores maintenance message information for representing instructions relating to maintenance of laser printer 11. A memory (RAM) 403 temporarily stores image data supplied from host unit 409, for example, a personal computer or an image reading apparatus and so on. An extended memory 404 stores image data when one-page data may not be stored in RAM 403. A video RAM 405 stores bit map data corresponding to image data supplied from host unit 409. The bit map data output from video RAM 405 is supplied to a parallel/serial converter 406. Parallel/serial converter 406 converts the supplied bit map data into serial data, and then the serial data is supplied from parallel/serial converter 406 to engine controller 34.

A host interface 408 interfaces data exchange between host unit 409 and printer controller 400. Host interface 408 includes a serial transfer line 410*a* and a parallel transfer line 410*b*. Transfer lines 410*a* and 410*b* may be selectively used in accordance with the type of data transferred from host unit 409. An engine interface 411 interfaces the exchange of an interface signal S4 between printer controller 33 and engine controller 34. Connecting circuits 413*a* and 413*b* disconnect power sources (not shown) and signal lines (not shown) from IC cards 414*a* and 414*b* so that data stored in IC cards 414*a* and 414*b* may is not destroyed by noise when IC cards 414*a* and 414*b* are inserted into or removed from connectors 35 and 36.

An operation panel control circuit 407 controls the liquid crystal display element (not shown) of operation panel 23 and so on. An internal bus 412 allows data exchange between CPU 401, ROM 402, RAM 403, extended memory 404, video RAM 405, operation panel control circuit 407, host interface 408, engine interface 411 and connecting circuit 413.

Figure 7:
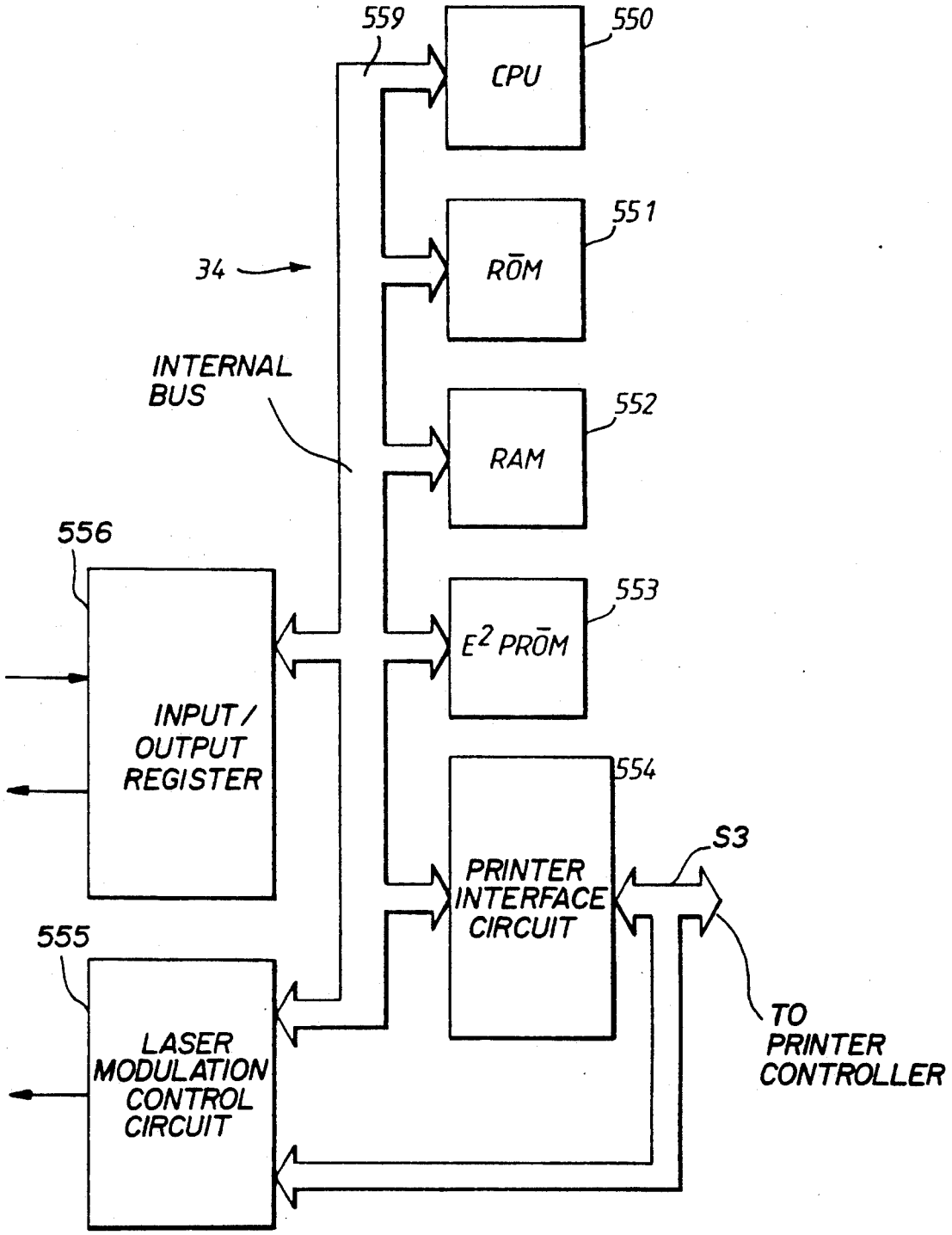
FIG. 7 is a block diagram showing an arrangement of a motor controller of the image forming apparatus shown in FIG. 1.

FIG. 7 shows an arrangement of engine controller 34. Referring to FIG. 7, engine controller 34 includes a CPU 550, a ROM 551, a RAM 552, an E²PROM 553, a printer interface circuit 554, a laser modulation control circuit 555, an input/output register 556 and an internal bus 559.

CPU 550 controls the image forming operation of laser printer 11 and overall operation of engine controller 34. CPU 550 is operated in accordance with control programs stored in ROM 551. RAM 552 is used for a work buffer for CPU 550. E²PROM 553 stores a total print count of laser printer 11 and a total print count of process unit 130 mounted on body 13 of laser printer 11. The total print counts of laser printer 11 and processing unit 130 are detected by detecting device 202 and are stored in E²PROM 553 through input/output register 556. The contents of E²PROM 553 are not lost even if the power switch is turned off. Therefore, the total print counts of laser printer 11 and processing unit 130 may be stored in E²PROM 553. The print counts stored in E²PROM 553 respectively are increased by one every time a paper sheet passes through rollers 123. The print count of the processing unit is initialized when the processing unit mounted on body 13 of laser printer 11 is replaced with a new processing unit. Printer interface circuit 554 exchanges an interface signal S3 with printer controller 33. Laser modulation control circuit 555 controls semiconductor laser 151 so as to generate laser beam L in response to data supplied from host unit 409 through printer controller 33. Internal bus 559 causes to exchange data between CPU 550, ROM 551, RAM 552, E²PROM 553, printer interface circuit 554, laser modulation control circuit 555 and input/output register 556.

An initializing operation of detecting device 202 and E²PROM 553 when the processing unit is replaced will next be explained.

Processing unit 130 includes an activating member (not shown). The activating member initializes counting portion 202*a* by engaging within initializing switch 202*b* when the new processing unit is mounted in laser printer 11. When the new processing unit is mounted in laser printer 11, the activating member activates initializing switch 202*b*. Thus, counting portion 202*a* is initialized by initializing switch 202*b*. At this time, also, detecting device 202 supplies an initializing signal to engine controller 34. CPU 550 initializes the print count of processing unit stored in E²ROM 553 in response to the received initializing signal.

When the new processing unit mounted on body 13 is subsequently actuated, detecting device 202 begins a counting operation for measuring the amount of use of the mounted processing unit, and is incremented each time an image forming operation is performed by processing unit. Also, the print count stored in E²ROM 553 is incremented each time an image forming operation responsive to the amount of use of the mounted processing unit detected by detecting device 202.

Moreover, when a used processing unit is mounted on laser printer 11, counting portion 202*a* will not be initialized by the activating member because the activating member is separated from initializing switch 202*a*.

Therefore, the initializing operation of detecting device 202 and E²PROM 553 can only be performed when a new processing unit is mounted on laser printer 11. Thereby, detecting device 202 and E²PROM 553 are initialized only when the mounted processing unit is replaced with the new processing unit. Thus, the image forming apparatus of the present invention accurately performs the service life management of the processing unit.

Figure 9:
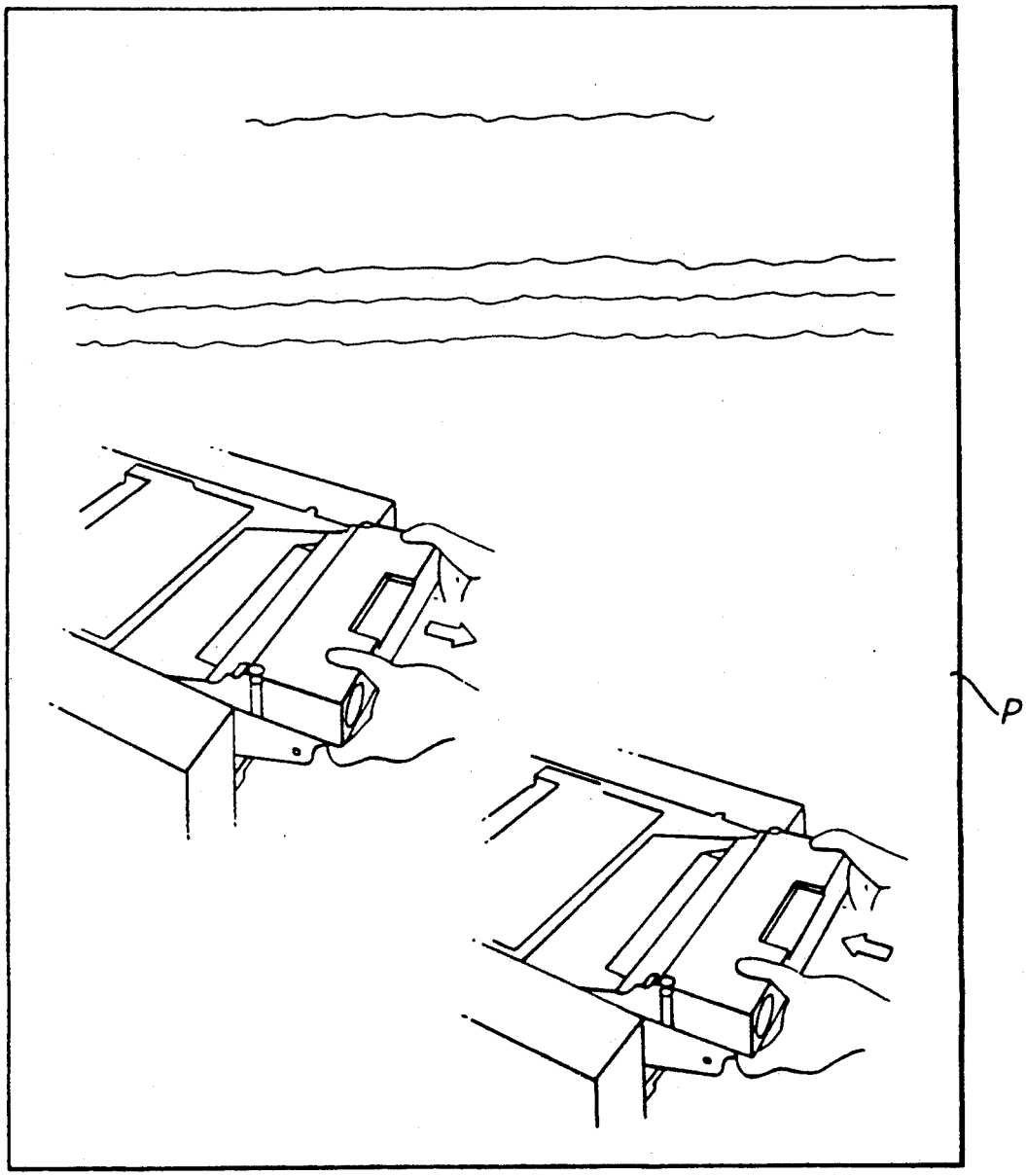
FIG. 9 shows a maintenance information message printed on a paper sheet for presenting the method of replacing the processing unit shown in FIG. 3.

Next, the image forming operation of maintenance message information of laser printer 11, for example, the replacement of the processing unit 130, will be described with reference to FIGS. 8A–B and 9.

Processing unit 130 mounted on body 13 of laser printer 11 is replaced with a new processing unit when the service life of image bearing member 102 contained in the processing unit expires. Therefore, for example, the user has to replace processing unit 130 about every 8,000 sheets. In order to warn the user of when the service life of processing unit 130 expires, laser printer 11 may perform the following maintenance message information printing operation.

When printer controller 33 receives image data to be printed from host unit 409 (step ST11), printer controller 33 converts the received image data into bit image data and outputs the data to engine controller 34 (step ST12). Engine controller 34 receives bit image data to be printed from printer controller 33 (step ST13), and CPU 550 of engine controller 34 determines whether the print count of the processing unit stored in E²PROM 553 is 8,000 or more (step ST14).

When CPU 550 determines in step ST14 that the print count of processing unit is 8,000 or more and that a processing unit replacement operation is required, a status signal representing a requirement of replacement of processing unit is output from CPU 550 (step ST15). If CPU 550 determines in step ST14 that the print count of processing unit 130 is 8,000 or less, the maintenance message information printing operation is not performed and the image forming operation is not performed and the image forming operation of bit image data received from host unit 409 only is performed (step ST16).

When a status signal representing a requirement of replacement of the processing unit is output from engine controller 34 to printer controller 33, CPU 401 of printer controller 33 determines whether all image data supplied from host unit 409 is output to engine controller 34 (step ST17). When all image data supplied from host unit 409 is not output to engine controller 34, the image data output processing to engine controller 34 is continuously executed (step ST18), and engine controller 34 performs the image forming operation of bit image data received from printer controller 33 (step ST19). In this state, when all image data supplied from host unit 409 has been output to engine controller 34, maintenance message information representing a replacement operation sequence of the processing unit is read out from ROM 402 of printing controller 33 (step ST20). The maintenance message information is stored as code information in ROM 402. The maintenance message information read out from ROM 402 is converted into bit image data (character image and picture image), and the converted bit image data is output to engine controller 34 (step ST21).

When engine controller 34 receives the maintenance message information, CPU 550 performs the image forming operation to form an image of the maintenance message information on paper sheet P (steps ST22 and ST23). In steps ST 22 and ST 23, the converted bit image data of the maintenance message information is supplied to engine controller 34. Engine controller 34 controls laser unit 150 so that image bearing member 102 is exposed with light in accordance with the received bit image data so as to form an image corresponding to the maintenance message information. The image formed on image bearing member 102 is developed by developing unit 133 and transferred on paper sheet P by transfer unit 134. The transferred maintenance message information is fixed on paper sheet P by fixing unit 160, such that this information is printed on paper sheet P. Thus, the maintenance information message is formed on paper sheet P, as is shown in FIG. 9. In this case, the character image data (message information) requesting the replacement of processing unit and the picture image data representing the replacement method of processing unit are formed on paper sheet P. For example, the message information is printed on paper sheet P in such a manner as "THE PRINT COUNT HAS REACHED 8,000 SHEETS. PLEASE OPEN THE UPPER COVER AND REPLACE THE PROCESSING UNIT BY A NEW UNIT BY REFERRING TO THE PRINTED MATTER." Also, the picture image data shows both the removing method and the mounting method of processing unit.

Therefore, the user can easily perform the replacement of the processing unit in accordance with the procedures described in the printed matters of the operation manual. Also, in the above image forming operation, the only maintenance message information is formed on one paper sheet. Thus, the user may easily distinguish the paper sheet having the image supplied from host unit 409 and the paper sheet having the maintenance information message printed thereon.

As described above, in the image forming apparatus of the present invention, the maintenance message information to be printed is stored in ROM 402 of printer controller 33. Also, the print count of processing unit 130 mounted on laser printer 11 is stored in $E^2$PROM 553. The maintenance message information for replacing processing unit 130 is read out from ROM 402 when the print count stored in $E^2$PROM 553 counts a predetermined value, for example 8,000 sheets. The readout maintenance information is supplied to engine controller 34 and then engine controller 34 performs the image forming operation to form an image of the maintenance message information on paper sheet P. Thus, the user may easily perform the replacement of the processing unit with reference to the printed maintenance information without preparing the maintenance manual at the time of replacement of the processing unit.

The replacement operation sequence of the processing unit is automatically printed on a paper sheet P at the time of the replacement. Any user may easily perform the replacement of the processing unit when the service life of the processing unit expires. Thus, the image forming apparatus of the present invention accurately performs the service life management of the processing unit.

It should be understood that the detailed description and examples, while indicating presently preferred embodiments of the present invention, are given by way of illustration only. Various modifications and changes may be made to the present invention without departing from scope or spirit of the invention, as set forth in the following claims.

We claim:

1. An image forming apparatus for performing an image forming operation on an image bearing member, the image forming apparatus comprising:

a processing unit, including the image bearing member and a processing means for acting on the image bearing member, to perform the image forming operation during the service life of the processing unit;

a main body to which the processing unit is detachably mounted, wherein the processing unit mounted on the main body may be replaced with a new processing unit when the service life of the mounted processing unit expires;

means for detecting a performance of the image forming operation of the processing unit so as to measure an amount of use of the processing unit;

first memory means for storing the amount of use of the processing unit mounted on the main body, as measured by the detecting means;

second memory means for storing maintenance message information containing instructions for replacing the processing unit mounted on the main body with the new processing unit when the service life of the mounted processing unit expires;

means for causing the processing means to form the maintenance message information stored in the second memory means on to the image bearing member when the amount of use stored in the first memory means is a value having a predetermined relationship to the service life; and means for printing the maintenance message information formed on the image bearing member on a recording medium.

2. An image forming apparatus according to claim 1, wherein the maintenance message information includes character image data requesting a replacement operation of the processing unit mounted on the main body and picture image data representing a replacement method for replacing the processing unit.

3. An image forming apparatus according to claim 1, further comprising means for converting bit image data into the maintenance message information stored in the second memory means so as to form the maintenance message information on the image bearing member.

4. An image forming apparatus according to claim 1, further comprising means for initializing a value of the amount of use stored in the first memory means when the new processing unit is mounted on the main body.

5. An image forming apparatus for performing an image forming operation during a service life, to form an image corresponding to data received from a host unit on an image bearing member, the image forming apparatus comprising:

a processing unit having both the image bearing member and a processing means for acting on the image bearing member to perform the image forming operation;

a main body to which the processing unit is detachably mounted, wherein the processing unit mounted on the main body may be replaced with a new processing unit when the service life of the mounted processing unit expires;

first memory means for storing the amount of use of the processing unit mounted on the main body;

second memory means for storing maintenance message information containing instruction for replacing the processing unit mounted on the main body with the new processing unit when the service life of the mounted processing unit expires;

first detecting means for detecting when an amount of use stored in the first memory means reaches a predetermined value and outputting a detecting signal;

second detecting means responsive to the detecting signal received from the first detecting means for detecting that the image forming operation in response to data received from a host unit is completely performed;

means for causing the processing means to form the maintenance message information stored in the second memory means on the image bearing member in response to the second detecting means; and means for printing the maintenance message information formed on the image bearing member on a recording medium.

6. An image forming apparatus according to claim 1, wherein the maintenance message information has character image data requesting a replacement operation of the processing unit mounted on the main body and picture image data representing a replacement method for replacing the processing unit.

7. An image forming apparatus according to claim 1, further comprising means for converting bit image data into the maintenance message information stored in the second memory means, so as to form the maintenance message information on the image bearing member.

8. An image forming apparatus according to claim 1, further comprising means for initializing a value of the amount of use stored in the first memory means when the new processing unit is mounted on the main body.

9. An image forming apparatus according to claim 1, further comprising detecting means for detecting a performance of the image forming operation of the processing unit so as to measure the amount of use of the processing unit.

* * * * *